US009693625B2

(12) United States Patent
Lu

(10) Patent No.: US 9,693,625 B2
(45) Date of Patent: Jul. 4, 2017

(54) STUDENT CHAIR

(71) Applicant: KIMBALL INTERNATIONAL, INC., Jasper, IN (US)

(72) Inventor: Endison Lu, Dongguan (CN)

(73) Assignee: Kimball International, Inc., Jasper, IN (US)

( * ) Notice: Subject to any disclaimer, the term of this patent is extended or adjusted under 35 U.S.C. 154(b) by 133 days.

(21) Appl. No.: 14/731,935

(22) Filed: Jun. 5, 2015

(65) Prior Publication Data

US 2016/0353887 A1 Dec. 8, 2016

(51) Int. Cl.

| | |
|---|---|
| ***A47C 1/00*** | (2006.01) |
| ***A47B 83/02*** | (2006.01) |
| ***A47C 3/18*** | (2006.01) |
| ***A47C 7/62*** | (2006.01) |

(52) U.S. Cl.

CPC ..... *A47B 83/02* (2013.01); *A47C 3/18* (2013.01); *A47C 7/62* (2013.01)

(58) Field of Classification Search

CPC ..... A47B 83/02; A47B 39/00; A47C 3/18; A47C 7/62; A47C 7/68; A61G 5/1072

USPC ..... 297/160–162, 170–173, 188.04, 344.21

See application file for complete search history.

(56) References Cited

U.S. PATENT DOCUMENTS

| | | | | |
|---|---|---|---|---|
| 564,044 A | | 7/1896 | Berkemeyer | |
| 1,023,620 A | * | 4/1912 | Burge | A47C 3/026 248/405 |
| 1,322,551 A | | 11/1919 | Efaw | |
| 1,352,409 A | | 9/1920 | Hoefener | |
| 1,391,222 A | | 9/1921 | Van Fleet | |
| 2,642,118 A | * | 6/1953 | Lamb | A47C 3/04 297/239 |
| D181,945 S | | 1/1958 | Saarinen | |
| D183,416 S | | 8/1958 | Bellmann | |
| D197,283 S | | 1/1964 | Williams | |
| 3,380,778 A | * | 4/1968 | Barecki | A47C 3/04 297/160 |
| 3,567,277 A | | 3/1971 | Van Ryn | |

(Continued)

FOREIGN PATENT DOCUMENTS

| | | |
|---|---|---|
| CN | 201968154 | 9/2011 |
| CN | 202014837 | 10/2011 |

(Continued)

*Primary Examiner* — Jose V Chen

(74) *Attorney, Agent, or Firm* — Faegre Baker Daniels LLP

(57) ABSTRACT

A seat pivotably mounted to a seat base via a swivel connector, and a work surface assembly pivotably mounted above the seat base and below the seat via the swivel connector. In particular, a bushing may be attached to an outer surface of the swivel connector in a manner in which the bushing is axially fixed, yet rotatable relative to the swivel connector, such as via an arrangement of protrusions and grooves on the bushing and connector, respectively. A portion of the tablet arm is received over the bushing, such that the bushing provides a low-friction interface between work surface assembly and the seat. In this arrangement, the pivot connection between the work surface assembly and the chair is functionally independent of the pivot connection between the seat and seat base. This functional independence facilitates assembly of the work surface assembly to the chair, and allows the pivotable work surface to be retrofit to preexisting swivel chairs.

17 Claims, 4 Drawing Sheets

(56) References Cited

U.S. PATENT DOCUMENTS

| | | | | | |
|---|---|---|---|---|---|
| 3,601,443 | A | | 8/1971 | Jones | |
| 3,604,749 | A | * | 9/1971 | Parmett | A47C 3/04 297/239 |
| 3,628,832 | A | * | 12/1971 | Jennings | A47C 3/12 297/160 |
| 3,771,226 | A | | 11/1973 | Lieb et al. | |
| D230,669 | S | | 3/1974 | Hendrickson et al. | |
| 3,814,474 | A | | 6/1974 | Baker et al. | |
| 4,087,071 | A | * | 5/1978 | Parker | A47C 3/24 248/406.1 |
| 4,136,908 | A | | 1/1979 | Crayne | |
| 4,203,624 | A | | 5/1980 | Hopkins | |
| D261,577 | S | | 11/1981 | Heritage | |
| D261,578 | S | | 11/1981 | Heritage | |
| 4,315,613 | A | * | 2/1982 | Godwin | A47C 3/245 108/147 |
| 4,494,721 | A | * | 1/1985 | Trinkel | A47C 3/18 248/406.2 |
| 4,586,747 | A | * | 5/1986 | Taylor | A47D 1/004 297/181 |
| 4,645,081 | A | * | 2/1987 | Korth | F16B 7/105 108/141 |
| 4,709,894 | A | * | 12/1987 | Knoblock | A47C 3/12 248/406.2 |
| 4,807,929 | A | * | 2/1989 | Balsbaugh | A47C 3/04 297/188.04 |
| 5,169,210 | A | * | 12/1992 | Fricano | A47C 7/70 248/282.1 |
| 5,601,331 | A | | 2/1997 | Austin, Jr. et al. | |
| 5,860,697 | A | * | 1/1999 | Fewchuk | A47C 3/04 297/188.04 |
| 5,954,393 | A | | 9/1999 | Perrin | |
| 6,231,126 | B1 | * | 5/2001 | Cheng | A47C 3/00 297/326 |
| 6,375,171 | B1 | * | 4/2002 | Zimmermann | B25F 5/006 267/137 |
| 6,409,268 | B1 | * | 6/2002 | Cvek | A47C 7/405 297/284.4 |
| 6,422,646 | B1 | * | 7/2002 | McNally | A47C 7/70 297/149 |
| 6,568,757 | B2 | * | 5/2003 | Lin | A47C 3/026 248/161 |
| 6,634,717 | B2 | * | 10/2003 | Kown | A47C 3/023 297/160 |
| 6,669,282 | B2 | | 12/2003 | Piretti | |
| 6,776,452 | B2 | * | 8/2004 | Onishi | A47B 83/02 108/143 |
| D497,261 | S | | 10/2004 | Epp et al. | |
| 7,073,853 | B2 | | 7/2006 | Onishi | |
| 7,128,368 | B2 | * | 10/2006 | Sligh | G10D 13/00 297/186 |
| 7,370,910 | B2 | | 5/2008 | Piretti | |
| 7,530,632 | B2 | * | 5/2009 | Kaloustian | A47C 7/68 297/161 |
| 7,552,974 | B2 | * | 6/2009 | Babikian | A47D 1/00 297/183.1 |
| 7,686,395 | B2 | * | 3/2010 | Piretti | A47C 7/405 297/297 |
| 7,726,732 | B1 | | 6/2010 | Keating | |
| 7,731,277 | B2 | | 6/2010 | Weber et al. | |
| D636,612 | S | * | 4/2011 | Overthun | D6/338 |
| D636,613 | S | | 4/2011 | Overthun et al. | |
| D646,085 | S | | 10/2011 | Overthun et al. | |
| D646,497 | S | | 10/2011 | Overthun et al. | |
| D648,158 | S | | 11/2011 | Kubryk | |
| D649,368 | S | | 11/2011 | Benden | |
| D667,243 | S | * | 9/2012 | Su | D6/716 |
| D674,615 | S | | 1/2013 | Blomstrom et al. | |
| D679,517 | S | | 4/2013 | Corcorran et al. | |
| D679,523 | S | | 4/2013 | Corcorran et al. | |
| D679,524 | S | | 4/2013 | Corcorran et al. | |
| D679,525 | S | | 4/2013 | Corcorran et al. | |
| D679,923 | S | | 4/2013 | Corcorran et al. | |
| D689,723 | S | | 9/2013 | Corcorran et al. | |
| D690,143 | S | | 9/2013 | Corcorran et al. | |
| D690,545 | S | * | 10/2013 | Blomstrom | D6/341 |
| D694,054 | S | | 11/2013 | Blomstrom et al. | |
| 8,696,056 | B2 | * | 4/2014 | Corcorran | A47B 39/00 297/170 |
| D751,329 | S | * | 3/2016 | Johnson | D6/374 |
| 9,469,255 | B2 | * | 10/2016 | Kucera | B60R 11/0235 |
| 2004/0041446 | A1 | * | 3/2004 | Onishi | A47B 83/02 297/170 |
| 2004/0195884 | A1 | * | 10/2004 | Gardner | A47C 3/18 297/344.21 |
| 2005/0046257 | A1 | * | 3/2005 | Pernicka | A47B 83/02 297/344.21 |
| 2005/0140187 | A1 | | 6/2005 | Kordecki | |
| 2005/0284920 | A1 | | 12/2005 | Martin et al. | |
| 2007/0267902 | A1 | | 11/2007 | Hill et al. | |
| 2008/0231091 | A1 | * | 9/2008 | Goranson | A47C 7/70 297/135 |
| 2011/0109135 | A1 | * | 5/2011 | Davis, Jr. | A47C 3/18 297/217.4 |
| 2011/0187164 | A1 | * | 8/2011 | Corcorran | A47B 39/00 297/170 |
| 2012/0126587 | A1 | | 5/2012 | Seo | |
| 2012/0267923 | A1 | * | 10/2012 | Bouche | A47C 7/70 297/161 |
| 2014/0097650 | A1 | | 4/2014 | Corcorran et al. | |
| 2014/0210237 | A1 | | 7/2014 | Corcorran et al. | |
| 2015/0366356 | A1 | * | 12/2015 | Corcorran | A47B 39/00 297/160 |

FOREIGN PATENT DOCUMENTS

| | | | |
|---|---|---|---|
| DE | 299 07 084 | | 9/1999 |
| DE | 201 02 904 | | 8/2002 |
| FR | 2 837 682 | | 10/2003 |
| GB | 2 358 792 | | 8/2001 |
| JP | 06156125 | A * | 6/1994 |
| JP | 06304034 | A * | 11/1994 |
| JP | 2002058564 | | 2/2002 |
| JP | 2002153354 | | 5/2002 |
| JP | 2002300933 | | 10/2002 |
| JP | 2003038295 | | 2/2003 |
| JP | 2005230304 | | 9/2005 |
| JP | 2010046397 | | 3/2010 |
| KR | 2008046365 | | 5/2008 |
| NL | 1014334 | | 8/2001 |

* cited by examiner

STUDENT CHAIR

BACKGROUND

1. Field of the Disclosure

The present disclosure relates to chairs, and more particularly, to task chairs including an ambidextrous pivoting work surface.

2. Description of the Related Art

Furniture used in academic settings such as schools and libraries is preferably durable and cost effective, such that the furniture can be purchased in relatively large quantities and placed in regular service over a long period of time. In classroom settings, for example, a chair and desk may be provided for each student, each being lightweight and having a relatively small footprint so that the chairs and desks can be configured in various ways within and among classrooms. Such lightweight furniture may include a molded seat shell attached to a chair leg assembly, as well as a basic desk or table sized to receive the chair.

In some configurations, a seat or seat shell may be provided with a "tablet arm" type work surface which is connected to the seat and provides a work surface at a predetermined position and configuration relative to the seat area. In some arrangements, the tablet arm may be pivotably attached to the seat so that the work surface can be selectively placed in right-hand or left-hand configurations.

What is needed is an improvement over the foregoing.

SUMMARY

The present disclosure provides a seat pivotably mounted to a seat base via a swivel connector, and a work surface assembly pivotably mounted above the seat base and below the seat via the swivel connector. In particular, a bushing may be attached to an outer surface of the swivel connector in a manner in which the bushing is axially fixed, yet rotatable relative to the swivel connector, such as via an arrangement of protrusions and grooves on the bushing and connector, respectively. A portion of the tablet arm is received over the bushing, such that the bushing provides a low-friction interface between work surface assembly and the seat. In this arrangement, the pivot connection between the work surface assembly and the chair is functionally independent of the pivot connection between the seat and seat base. This functional independence facilitates assembly of the work surface assembly to the chair, and allows the pivotable work surface to be retrofit to preexisting swivel chairs.

In one form thereof, the present disclosure provides a chair, including: a seat comprising a horizontal support portion and a seat back portion extending upwardly away from the horizontal support portion; a seat base disposed beneath the horizontal support portion of the seat; a swivel connector defining a longitudinal axis extending between an upper connector portion and a lower connector portion, the upper connector portion attached to the horizontal support portion of the seat and the lower connector portion attached to the seat base, the upper connector portion pivotable with respect to the lower connector portion such that the seat is pivotable with respect to the seat base; and a work surface assembly including: an attachment arm having a radial inward end adjacent the swivel connector and extending radially outwardly from the swivel connector; a pivot mounting portion fixed to the radial inward end of the attachment arm, the pivot mounting portion having a bore sized and configured to receive the swivel connector; a riser arm fixed to and extending upwardly from the attachment arm to an upper end of the riser arm; and a work surface connected to the upper end of the riser arm; and a bushing having an outer bushing surface and an inner bushing surface, the outer bushing surface abutting an inner surface of the bore of the pivot mounting portion, the inner bushing surface abutting an outer surface of the swivel connector, whereby the bushing comprises a single bushing disposed between the swivel connector and the pivot mounting portion.

In another form thereof, the present disclosure provides a chair, including: a seat comprising a horizontal support portion and a seat back portion extending upwardly away from the horizontal support portion, the seat back including: a left lateral edge defining a left upper end; a right lateral edge defining a right upper end; and a top edge extending from the left upper end to the right upper end, the top edge having a central depression below the left upper end and the right upper end whereby backpack straps can be retained along the top edge; a seat base disposed beneath the horizontal support portion of the seat; a swivel connector pivotably attaching the seat to the seat base; and a work surface assembly including: an attachment arm having a radial inward end pivotably attached to the swivel connector, the attachment arm extending radially outwardly from the swivel connector; a riser arm fixed to and extending upwardly from the attachment arm to an upper end of the riser arm; and a work surface connected to the upper end of the riser arm.

In a further form thereof, the present disclosure provides a method of assembling a chair, the method including the steps of: fixing an upper portion of a swivel connector to a seat; fixing a lower portion of the swivel connector to a seat base such that the seat and the seat base are pivotably connected; pivotably connecting a work surface assembly to the chair by the steps of: connecting a bushing to an outer surface of the swivel connector; and lowering a pivot mounting portion of the work surface assembly over the bushing such that the upper portion of the swivel connector protrudes upwardly through the pivot mounting portion.

BRIEF DESCRIPTION OF THE DRAWINGS

The above-mentioned and other features of the disclosure, and the manner of attaining them, will become more apparent and will be better understood by reference to the following description of embodiments of the disclosure taken in conjunction with the accompanying drawings, wherein.

Corresponding reference characters indicate corresponding parts throughout the several views. The exemplifications set out herein illustrate embodiments of the disclosure and such exemplifications are not to be construed as limiting the scope of the invention in any manner.

DETAILED DESCRIPTION

Figure 1:
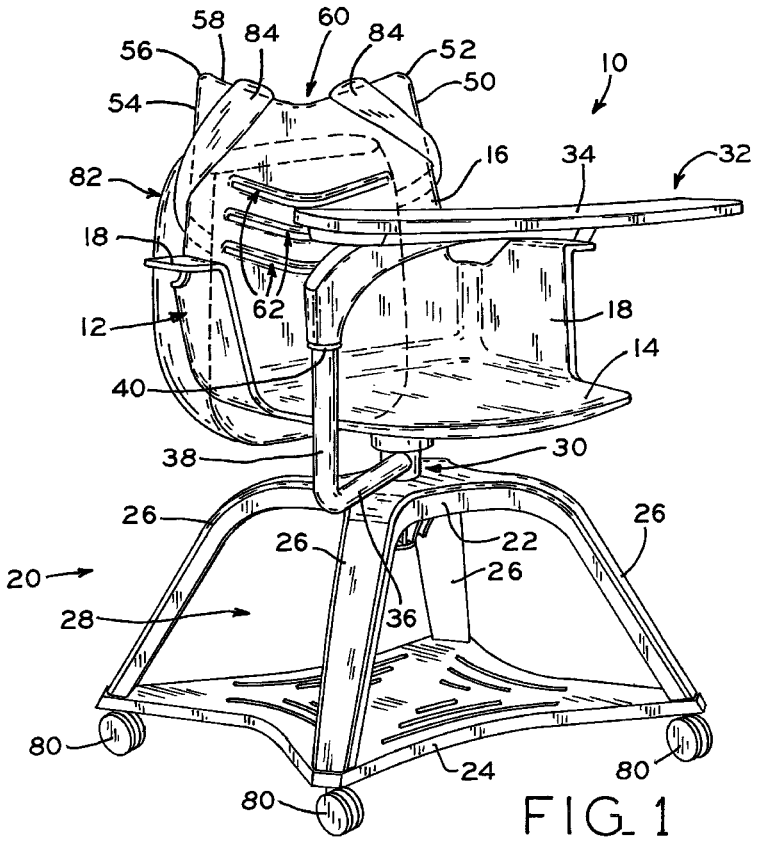
FIG. 1 is a perspective view of a fully assembled chair made in accordance with the present disclosure, and having a backpack hung from the seat back portion of the seat.

The present disclosure provides chair 10, shown in FIG. 1, which has a functional and modular design efficiently producible in the large quantities sometimes required for, e.g., classroom settings while also providing a high degree of comfort and convenience. As described in detail below, seat 12 is pivotably connected to seat base 20 via swivel connector 30, which in turn provides a mounting surface for a tablet arm as part of a work surface assembly 32. This arrangement facilitates assembly of chair 10 and facilitates a retrofit attachment of work surface assembly 32 to existing chairs. Other features, such as a chevron-shaped top edge 58 of seat 12, a large cargo space 28, and castors 80, combine to provide a chair and work surface which functions as a self-contained unit for an individual student and his or her belongings, and which can be easily rearranged and reconfigured around a room.

Seat 12 may be a molded plastic seat shell including horizontal support portion 14 and a seat back portion 16 extending upwardly away from the rear portion of the horizontal support 14, both sized and shaped to receive and support a user of chair 10. Arm rest portions 18 extend upwardly from the horizontal support portion 14 and forwardly from seat back portion 16 as illustrated. In an exemplary embodiment, the horizontal support 14, seat back 16, and arm rests 18 are all molded from a molten plastic material into the desired shape, and then allowed to cure such that seat 12 is formed as a single monolithic part. This monolithic plastic seat shell design is cost-effectively producible in large quantities, and can be efficiently shipped, warehoused and assembled to the other structures of chair 10, while also providing an ergonomic and comfortable seat surface.

Seat base 20 includes upper support 22 disclosed directly beneath horizontal support 14 of seat 12, and four legs 26 extending downwardly from upper support 22 to lower support 24. Cargo space 28 is defined between upper support 22 and lower support 24, with lower support configured as a flat shelf for storage of articles. As described in further detail below, swivel connector 30 (FIG. 2) may be designed to occupy a minimal axial space between the uppermost portion of seat base 20 and the lowermost portion of seat 12, thereby allowing maximum vertical space between upper support 22 and lower support 24 which provides the largest cargo space 28 possible for a given height of seat 12. In the illustrated embodiment of FIG. 1, castors 80 are coupled to lower support 24 at the lower end of each of legs 26 to allow chair 10 to be easily moved from place to place.

As noted above, swivel connector 30 pivotably attaches seat 12 to seat base 20. Turning to FIG. 4, a basic arrangement of components which facilitates this pivotable connection is shown in detail. As illustrated, swivel connector 30 is a generally elongate structure (defining a longitudinal axis A shown in FIG. 3) having upper connector portion 90 defining an upper axial end of connector 30 and lower connector portion 92 defining a lower axial end of connector 30. Upper connector portion 90 may be formed as a solid pin, for example, with a tapered upper end sized to be received with a taper-fit relationship into seat bushing 42. Seat bushing 42 is in turn fixed within horizontal support 14 thereof, as shown, such that when the tapered portion of upper connector 90 is firmly received within the correspondingly tapered bushing 42, seat 12 (FIG. 1) is effectively fixed to upper connector portion 90. Moreover, placing weight on seat 12 (e.g., by a user sitting in seat 12) further reinforces this fixed connection. Similarly, lower connector portion 92 is a generally hollow tubular or cup-shaped member having a tapered lower end sized to form a taper-fit connection with base bushing 44, which in turn may be fixed to upper support 22 of seat base 20.

In the illustrated embodiment, low friction rotation between upper connector portion 90 and lower connector portion 92 is facilitated by an arrangement of thrust washers 96 and a thrust bearing 98 interposed between the lower axial end of upper connector portion 90 and the adjacent inner axial end surface of lower connector portion 92. Alignment sleeve 94 is received within lower connector portion 92 to constrain radial movement of upper connector portion 90 and thereby maintain the desired axial alignment between the upper and lower axial ends of connector 30.

The illustrated pivot mechanism of FIG. 4 provides an effective pivot connection between seat 12 and seat base 20, but various other pivot mechanisms may be utilized in accordance with the present disclosure. Exemplary alternative pivot mechanisms include mechanisms which provide for height adjustability between seat 12 and seat base 20.

Figure 3:
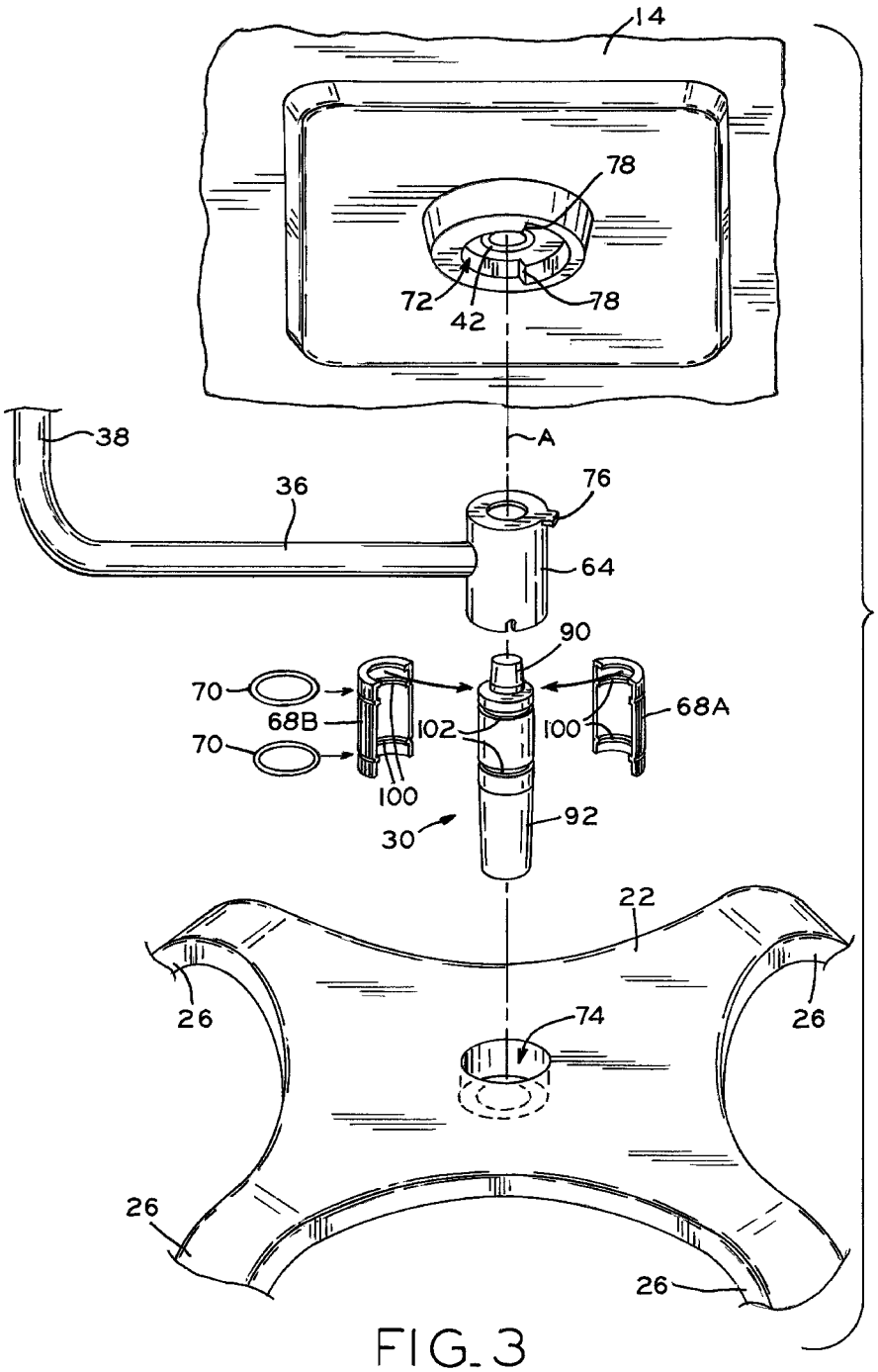
FIG. 3 is an exploded view of a portion of the chair of FIG. 1, including the components which create a pivotable connection between the work surface assembly and the swivel connector.
Figure 4:
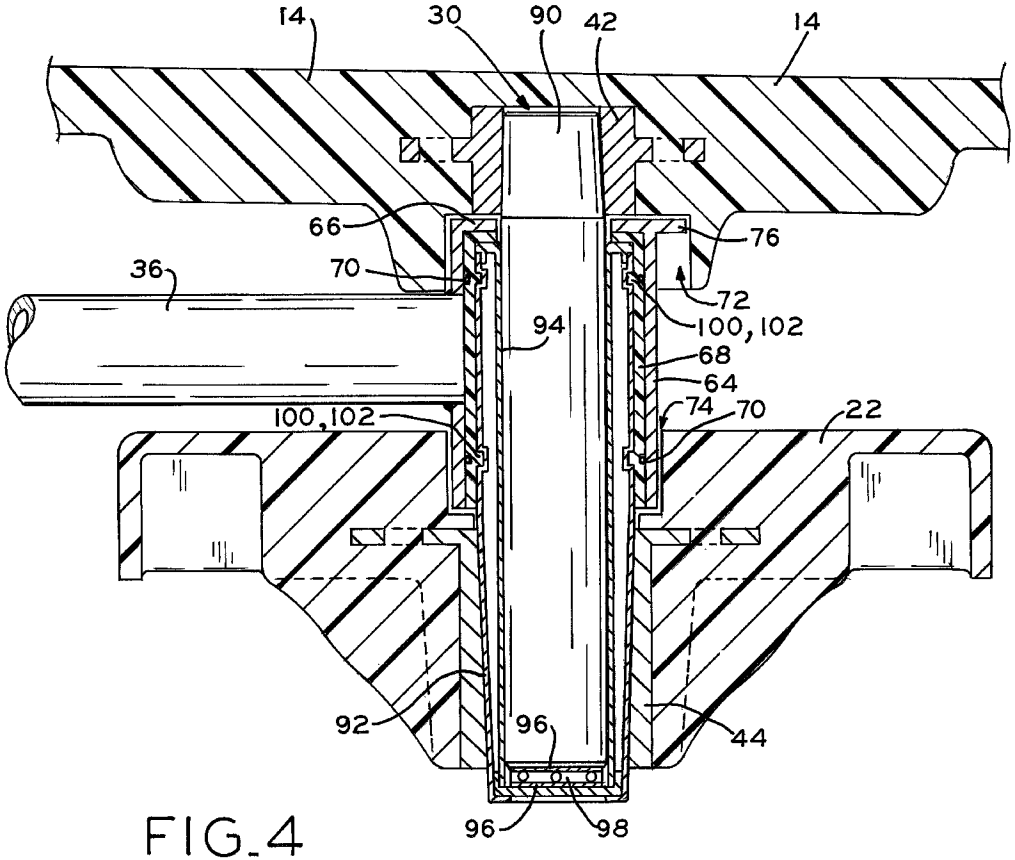
FIG. 4 is an elevation, cross-section view of the swivel connection of the chair shown in FIG. 1, together with the pivotable connection between the work surface assembly and the swivel connector.
Figure 5:
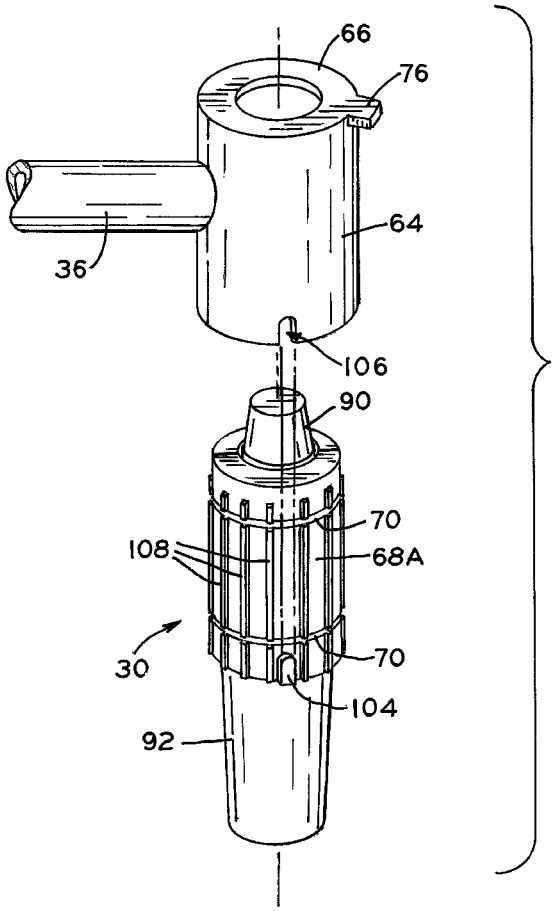
FIG. 5 is a perspective, exploded view of the pivotable connection between the work surface assembly and the swivel connector of FIG. 4.

Work surface assembly 32 includes work surface or tablet 34, and a tablet arm including riser arm 38 and attachment arm 36 extending downwardly and radially inwardly from work surface 34 to swivel connector 30, and a cylindrical pivot mounting portion 64 which facilitates the pivotable connection of work surface assembly 32 to swivel connector 30 via bushing 68, as shown in FIGS. 3-5 and further described below. Work surface assembly 32 also includes pivot connection 40 between work surface 34 and riser arm 38, which cooperates with the pivotable connection at swivel connector 30 to allow selective reconfiguration of work surface 34 between a right-hand configuration (shown in FIG. 1) and a left-hand configuration as further described below.

The cylindrical pivot mounting portion 64 is fixed to the radial inward end of attachment arm 36, such as by welding as shown in FIG. 4. Attachment arm 36 extends radially outwardly beyond the edge of support portion 14 of seat 12, where its radial outward end is fixed to riser arm 38. In an exemplary embodiment, attachment arm 36 and riser arm 38 are formed from a single piece of metal tubing with a bend to form the radial/vertical transition. Riser arm 38 extends upwardly from its connection with attachment arm 36 to pivot connection 40 with work surface 34.

Turning to FIG. 3, the outer surface of lower portion 92 of swivel connector 30 is shown in detail. As illustrated, the lower axial end of lower portion 92 is tapered to provide the taper-fit engagement with bushing 44, as shown in FIG. 4 and described above. The upper axial end of lower portion 92 is substantially cylindrical to provide a bearing surface for bushing 68, as described below, and includes a pair of axially spaced annular recesses 102. When bushing 68 is assembled to swivel connector (FIG. 5), and upper and lower annular protrusions 100 are snugly received in respective annular recesses 102 such that axial movement of bushing 68 with respect to the swivel connector 30 is prevented. In the illustrated embodiment, bushing 68 comprises two semi-cylindrical bushing halves 68A, 68B joined to one another and swivel connector 30 by an axially spaced pair of resilient retainer rings 70, though it is appreciated that bushing 68 could also be formed as a single cylindrical unit. In addition, although annular protrusions 100 are shown as being part of each bushing half 68A, 68B and recesses 102 are shown as being provided as part of swivel connector 30, it is appreciated that the opposite arrangement may be employed, i.e., protrusions may extend outwardly from the cylindrical mounting surface of swivel connector 30 while recesses may be formed in the inner cylindrical surface of bushing 68.

Cylindrical pivot mounting portion 64 has a central bore sized and configured to receive swivel connector 30 and bushing 68, as best seen in FIG. 4. Bushing 68 has an outer surface with a plurality of ribs 108 (FIG. 5) which abut the inner cylindrical surface of pivot mounting portion 64. The inner surface of bushing 68 abuts the outer surface of the cylindrical portion of lower portion 92 of swivel connector 30, as best seen in FIG. 4. Thus, bushing 68 is the only bushing disposed between swivel connector 30 and pivot mounting portion 64, which is an efficient design which also facilitates installation of work surface assembly 32 to chair 10 and provides for potential retrofit installations of work surface assembly 32 to existing chairs as further described below.

As best seen in FIG. 5, pivot mounting portion 64 includes an axial retainer lip 66 at its upper axial end which is configured as an annular flange sized to prohibit passage of bushing 68 and lower connector portion 92 through the upper axial end of pivot mounting portion 64 while allowing passage of upper connector portion 90. Similarly, each bearing half 68A, 68B includes bearing lip 110 (FIG. 5) which prohibits passage of lower connector portion 92 through the upper axial end of bushing 68 while allowing passage of upper connector portion 90. Upon assembly, the halves of bushing 68 may be received about swivel connector 30 over upper connector portion 90, with retainer rings 70 used to secure the bushing halves to one another about swivel connector 30. When positioned at the proper axial location, annular protrusions 100 snap into annular recesses 102 and bearing lip 110 rests upon the top surface of lower connector portion 92. Next, pivot mounting portion 64 is received over the upper connector portion 90 and bushing 68, and is fully seated when axial retainer lip 66 abuts bearing lip 110. In use, the weight of work surface assembly 32 (and any pressure or additional weight placed on work surface 34) is rotatably supported by the lubricious interface between swivel connector 30 and pivot mounting portion 64 provided by bearing lip 110.

This method of assembly is simple and intuitive, and can be accomplished with a minimal number of steps which minimizes labor costs associated with assembling chair 10. In addition, the pivotable attachment of seat 12 to base 20 via swivel connector 30 is functionally independent of the pivotably attachment of work surface assembly 32 to the chair 10. That is to say, work surface assembly 32 and all its associated components (including bushing 68) can be disassembled from chair 10 and removed without affecting the structure or function of the other components of chair 10, including swivel connector 30. Similarly, any swivel connector having a cylindrical outer surface can be substituted for swivel connector 30, regardless of its particular functions and features, while still being combinable with work surface assembly 32 without modification. For example, swivel connector 30 can be replaced with an alternative design including, e.g., a vertical adjustability mechanism without modification to work surface assembly 32.

Moreover, this functional independence between work surface assembly 32 and swivel connector 30 also allows for retrofit of work surface assembly 32 to existing chairs with existing swivel connectors, provided the existing swivel connector has a cylindrical outer surface sized to receive pivot mounting portion 64. To this end, bushing 68 may be replaced with an alternative bushing whose inner surface is sized to engage the cylindrical outer surface of an existing swivel connector. A set of such bushings may be made available to fit a number of standard swivel connectors found on existing chairs.

In an exemplary embodiment, the lubricious interface providing the pivotable connection between work surface assembly 32 and chair 10 is formed at the abutting surfaces of swivel connector 30 and the inner surface of bushing 68. To this end, pivot mounting portion 64 may include radial recess 106, best seen in FIG. 5. One or both of bushing halves 68A, 68B may include a correspondingly sized radial protrusion 104 received in recess 106. When the assembled bushing 68 and swivel connector 30 are received in the bore of pivot mounting portion 64 (as described above), protrusion 104 is received in recess 106 to rotatably fix bushing 68 to pivot mounting portion 64. This fixation ensures that bushing 68 will rotate only upon swivel connector 30 at the intended lubricious interface.

As noted above, work surface 34 is pivotably connected to the upper end of riser arm 38 via pivot connection 40, such that the work surface can be pivoted from a right-hand configuration to a left-hand configuration. In addition to pivot connection 40, pivot mounting portion 64 includes features which facilitate this functionality, as further described below.

The upper and lower axial end of pivot mounting portion 64 is received in upper opening 72 formed in horizontal support 14 of seat 12, while the lower axial end of pivot mounting portion 64 is received in lower opening 74 formed in upper support of seat base 20. In the illustrative embodiment of FIG. 3, pivot mounting portion 64 includes radial protrusion 76, which is received in upper opening 72 together with the axial upper end of mounting portion 64. Within upper opening 72, a pair of radial stops 78 are positioned to engage radial protrusion 76 at first and second angular configurations of the seat and the work surface corresponding to the left-hand and right-hand configurations of work surface assembly 32. Thus, radial stops 78 cooperate to define an angular spacing which defines a predetermined range of angular movement of the work surface. In the illustrated embodiment, stops 78 are about 170 degrees apart from one another such that the total angular movement of work surface assembly 32 is about 170 degrees, which is sufficient to define the left-hand and right-hand configurations.

Turning again to FIG. 1 and as noted above, seat 12 may further include a chevron shape along top edge 58 of seat back portion 16, to facilitate secure retention of backpack 82. In particular, seat back portion 16 includes left lateral edge 50 defining left upper end 52 (i.e., the end furthest from the adjacent arm rest 18), and right lateral edge 54 defining right upper end 56. A top edge 58 extends from left upper end 52 to right upper end 56, and defines a central depression 60 positioned below the left and right upper ends 52, 56 respectively. This depression 60, in combination with the higher left and right upper ends 52, 56, defines the distinct inverted chevron shaped of seat back portion 16.

The inverted chevron shape retains backpack straps 84 along the top edge when backpack 82 is hung from seat back 16, allowing a user of chair 10 to securely attach backpack 82 even if chair 10 is rolled around a room or jostled. In this way, the effective cargo carrying capacity of chair 10 is increased by the volume of whatever backpack 82 is secured to seat 12.

Seat back portion 16 further includes a plurality of apertures 62 for ventilation of seat back portion 16 while the user of chair 10 is seated. As illustrated in FIG. 1, each of apertures 62 defines a second chevron shape corresponding to the chevron shape defined by top edge 58, giving seat 12 a distinctive overall appearance.

Figure 2:
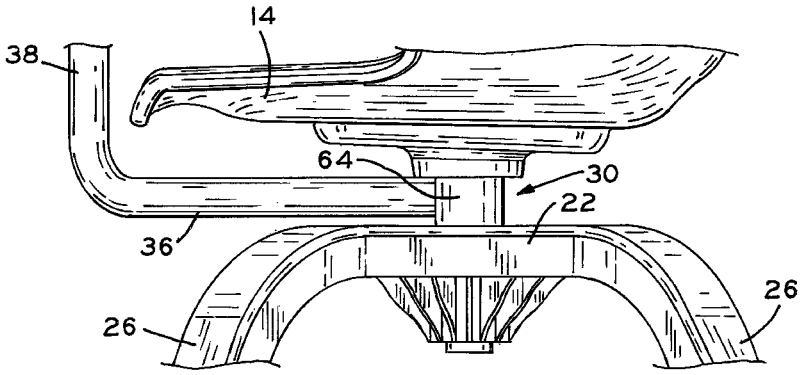
FIG. 2 is a side elevation view of a portion of the chair shown in FIG. 1, illustrating a swivel connection between the seat and seat base of the chair, with a work surface assembly pivotably mounted to the swivel connector.

In addition to the cargo carrying capacity of chair 10 via retention of backpack 82, seat base 20 may include a large cargo space 28 for further storage capacity as noted above. In order to maximize the vertical extent of cargo space 28, a lowermost portion of seat 12 (i.e., underneath support portion 14) includes upper opening 72 extending upwardly into support portion 14. An upper axial end of pivot mounting portion 64 is received in upper opening 72. Similarly, the uppermost portion of seat base 20 (i.e., above upper support 22) includes lower opening 74 extending downwardly into upper support 22 of the seat base 20. A lower axial end of pivot mounting portion 64 is received in lower opening 74. As best seen in FIG. 2, this arrangement allows for a minimized axial space between seat 12 and seat base 20, which in turn maximizes the vertical space available for cargo space 28.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. A chair, comprising:

a seat comprising a horizontal support portion and a seat back portion extending upwardly away from the horizontal support portion;

a seat base disposed beneath the horizontal support portion of the seat, said seat base having an opening and plurality of legs extending therefrom;

a swivel connector defining a longitudinal axis extending between an upper connector portion and a lower connector portion, the upper connector portion attached to the horizontal support portion of the seat and the lower connector portion being tapered in shape and received within and extending through the opening of the seat base with the lower connector portion directly engaging the opening of the base via a taper-fit connection, the upper connector portion pivotable with respect to the lower connector portion such that the seat is pivotable with respect to the seat base; and a work surface assembly comprising:

an attachment arm having a radial inward end adjacent the swivel connector and extending radially outwardly from the swivel connector;

a pivot mounting portion fixed to the radial inward end of the attachment arm, the pivot mounting portion having a bore sized and configured to receive the swivel connector;

a riser arm fixed to and extending upwardly from the attachment arm to an upper end of the riser arm; and a work surface connected to the upper end of the riser arm; and a bushing having an outer bushing surface and an inner bushing surface, the outer bushing surface directly abutting an inner surface of the bore of the pivot mounting portion, the inner bushing surface directly abutting an outer surface of the swivel connector, whereby the bushing comprises a single bushing disposed directly between the swivel connector and the pivot mounting portion with lower ends of both the pivot mounting portion and the bushing each disposed within the opening of the seat base.

2. The chair of claim 1, wherein:

the pivot mounting portion comprises a recess; and the bushing comprises a protrusion sized to be received in the recess when the bushing is received in the bore, such that the bushing and the pivot mounting portion are rotatably fixed to one another and the bushing is rotatable with respect to the swivel connector.

3. The chair of claim 1, wherein:

the swivel connector includes at least one annular recess in the outer surface; and the bushing includes at least one annular protrusion sized and configured to be received in the annular recess, such that axial movement of the bushing with respect to the swivel connector is prevented when the bushing is assembled to the swivel connector.

4. The chair of claim 1, wherein the bushing comprises two semi-cylindrical bushing halves joined by at least one retainer ring.

5. A chair, comprising:

a seat comprising a horizontal support portion and a seat back portion extending upwardly away from the horizontal support portion;

a seat base disposed beneath the horizontal support portion of the seat, said seat base having an opening and plurality of legs extending therefrom;

a swivel connector defining a longitudinal axis extending between an upper connector portion and a lower connector portion, the upper connector portion attached to the horizontal support portion of the seat and the lower connector portion being tapered in shape and received within and extending through the opening of the seat base with the lower connector portion directly engaging the opening of the base via a taper-fit connection, the upper connector portion pivotable with respect to the lower connector portion such that the seat is pivotable with respect to the seat base; and a work surface assembly comprising:

an attachment arm having a radial inward end adjacent the swivel connector and extending radially outwardly from the swivel connector;

a pivot mounting portion fixed to the radial inward end of the attachment arm, the pivot mounting portion having a bore sized and configured to receive the swivel connector;

a riser arm fixed to and extending upwardly from the attachment arm to an upper end of the riser arm; and a work surface connected to the upper end of the riser arm; and a bushing having an outer bushing surface and an inner bushing surface, the outer bushing surface abutting an inner surface of the bore of the pivot mounting portion, the inner bushing surface abutting an outer surface of the swivel connector, whereby the hushing comprises a single bushing disposed between the swivel connector and the pivot mounting portion with lower ends of both the pivot mourning portion and bushing each disposed within the opening of the seat base, and wherein:

the bushing abuts the outer surface of the swivel connector at the lower connector portion;

the pivot mounting portion includes an axial retainer lip at an upper axial end thereof, the axial retainer lip in axial abutment with an upper end of the bushing, the retainer lip sized to prohibit passage of the bushing and the lower connector portion therethrough, and the retainer lip sized to allow passage of the upper connector portion therethrough.

6. The chair of claim 1, wherein:

a lowermost portion of the seat comprises an upper opening extending upwardly into the horizontal support portion of the seat, an upper axial end of the pivot mounting portion received in the upper opening; and an uppermost portion of the seat base includes a lower opening extending downwardly into an upper support of the seat base, a lower axial end of the pivot mounting portion received in the lower opening.

7. The chair of claim 6, wherein:

the pivot mounting portion includes a radial protrusion received in the upper opening; and the upper opening includes a first radial stop positioned to engage the radial protrusion at a first angular configuration of the seat and the work surface, and a second radial stop positioned to engage the radial protrusion at a second angular configuration of the seat and the work surface, the first radial stop and the second radial stop cooperating to define an angular spacing which defines a predetermined range of angular movement of the work surface.

8. The chair of claim 7, wherein the work surface is pivotably connected to the upper end of the riser arm, such that the work surface can be pivoted from a right-hand configuration to a left-hand configuration.

9. The chair of claim 1, further comprising:

a seat bushing fixed within the horizontal support portion of the seat and sized to form a first friction-fit connection with the upper connector portion; and a base bushing fixed within an upper support of the seat base and sized to form a second friction-fit connection with the lower connector portion.

10. The chair of claim 9, wherein the first and second friction-fit connections are taper-fit connections, whereby downward pressure on the horizontal support portion of the seat reinforces fixation of the swivel connector to the seat and the seat base respectively.

11. The chair of claim 1, wherein the seat base comprises:

an upper support fixed to the lower connector portion; and a plurality of legs extending downwardly from the upper support, such that a cargo space is defined under the upper support.

12. The chair of claim 11, wherein the seat base further comprises a lower support connected to a lower portion of the plurality of legs, such that the cargo space is defined between the lower support and the upper support.

13. The chair of claim 1, wherein the seat comprises a seat shell in which the horizontal support portion and the seat back portion of the seat are formed as a single monolithic part.

14. The chair of claim 13, wherein the single monolithic part forming the seat further includes armrest portions extending upwardly from the horizontal support portion and forwardly from the seat back portion.

15. A method of assembling a chair, the method comprising the steps of:

fixing a lower portion of a swivel connector to a seat base including an opening and a plurality of legs extending therefrom by inserting a tapered lower end of the swivel connector through the seat base opening to directly engage the lower end of the swivel connector with the opening via a taper-fit connection;

pivotably connecting a work surface assembly to the chair by the steps of:

connecting a bushing to an outer surface of the swivel connector; and lowering a pivot mounting portion of the work surface assembly over the bushing such that the bushing abuts the outer surface of the swivel connector, the pivot mounting portion including an axial retainer lip at an upper axial end thereof sized to prohibit passage of the bushing and the lower connector portion therethrough, the axial retainer lip in axial abutment with an upper end of the bushing, and wherein lower ends of both the pivot mounting portion and the bushing are each disposed within the opening in the seat base and an upper portion of the swivel connector protrudes upwardly through the pivot mounting portion; and fixing an upper portion of the swivel connector to a seat.

16. The method of claim 15, wherein the step of connecting the bushing comprises lowering the bushing over a cylindrical surface of the swivel connector until a protrusion formed on one of the bushing and the swivel connector engages a correspondingly sized recess on the other of the bushing and the swivel connector, and the upper portion of the swivel connector protrudes upwardly through the bushing.

17. The method of claim 15, wherein the swivel connector is an existing swivel connector of a chair, the method further comprising choosing the bushing from among a set of bushings to fit the existing swivel connector.

* * * * *